United States Patent [19]

Williams et al.

[11] Patent Number: 4,690,669

[45] Date of Patent: Sep. 1, 1987

[54] REFRIGERATED CENTRIFUGE HAVING A REMOVABLE BOWL

[75] Inventors: John F. Williams, New Canaan; Emery L. Wagner, Norwalk, both of Conn.

[73] Assignee: E. I. Du Pont de Nemours and Company, Wilmington, Del.

[21] Appl. No.: 802,303

[22] Filed: Nov. 27, 1985

[51] Int. Cl.[4] ..... B04B 15/02

[52] U.S. Cl. ..... 494/14; 62/395; 366/144

[58] Field of Search ..... 494/13, 14, 84, 83, 494/82, 60, 61, 64; 62/395; 366/144, 145, 147, 148, 149

[56] References Cited

U.S. PATENT DOCUMENTS

| | | | |
|---|---|---|---|
| 2,788,643 | 4/1957 | Martin | 62/395 |
| 4,113,172 | 9/1978 | Pautsch | 494/14 |
| 4,193,536 | 3/1980 | Kubota | 494/14 |

*Primary Examiner*—Robert W. Jenkins

[57] ABSTRACT

A refrigerated centrifuge in which the bowl is removable from the interior of the casing while leaving the refrigeration coil in place.

5 Claims, 2 Drawing Figures

10
12
12A
12
24H
24
28
26
26
20
20
30
18
18
22
22
16
16
14
14
46
54
48
67
54A
68
72
38
36
34
40
R
42
62A
60A
70
76
74
58A
66B
66
78
32

REFRIGERATED CENTRIFUGE HAVING A REMOVABLE BOWL

BACKGROUND OF THE INVENTION

1. Field of the Invention

The present invention relates to a refrigerated centrifuge and, in particular, to a refrigerated centrifuge in which the bowl is removable therefrom.

2. Description of the Prior Art

Some centrifuge instruments are capable of refrigerating the bowl in which the rotating member, or rotor, is received. This is done to more effectively control the temperature of the samples for material under test. Exemplary of such refrigerated centrifuge instruments are those sold by E. I. du Pont de Nemours and Company, Inc., as "RC-3B," "RC-5C" and "OTD." These instruments respectively operate in the low speed, superspeed and ultraspeed ranges. In each case refrigeration for the bowl is provided by a refrigeration coil which is closely wrapped about the exterior of the bowl or, in some cases, formed integrally therewith. U.S. Pat. No. 3,409,212 (Durland et al.) discloses a refrigerated bowl of the type having refrigerant coils surrounding the chamber.

Other centrifuge instruments, such as that disclosed in U.S. Pat. No. 4,512,758 (Wedemeyer et al.), may be refrigerated through the use of a thermoelectric temperature control assembly which includes an array of thermoelectric heating and cooling elements mounted within the housing of the centrifuge and disposed beneath the bowl.

A refrigeration system which uses the circulation of a refrigerant such as freon through the refrigeration coil provides both heating and cooling effects that are believed to be more efficient by at least an order of magnitude over a temperature control system that uses thermoelectric cooling devices. However, since the coils are at least physically close if not integrally mounted with the bowl and also interconnected with the refrigeration system it is difficult and a time-consuming process to remove the bowl assembly. Thus, in those instances when it is believed necessary or desirable to quickly and efficiently remove the bowl assembly the interconnection of the refrigeration coil into the refrigeration system makes this difficult.

In view of the foregoing it is believed advantageous to provide a centrifuge instrument in which the bowl is refrigerated using the more efficient circulating refrigerant system yet, at the same time, in which the bowl may be quickly and expeditiously removed from the interior of the casing.

SUMMARY OF THE INVENTION

The present invention relates to a centrifuge comprising a casing having a drive member such as an electric motor or hydraulic turbine mounted within the casing. The drive member includes a shaft mounted for rotational movement about an axis of rotation. Mounted within the casing by means of a thermally insulating support plate is a refrigertion coil connected to a source of circulating refrigerant. The coil is arranged in a generally planar configuration and is generally concentric with the axis of rotation. A centrifuge bowl is removably mounted in the casing with the lower surface of the bowl disposed in thermal contact with the refrigeration coil. A thermally conductive material is provided on the underside of the bowl to form a good thermal contacting relationship between the undersurface of the bowl and the coil. The bowl is removable from the casing in an upwardly direction parallel to the axis of rotation.

BRIEF DESCRIPTION OF THE DRAWINGS

The invention will be more fully understood from the following detailed description thereof taken in connection with the accompanying drawings which form part of this invention and in which.

DETAILED DESCRIPTION OF THE INVENTION

Figure 1:
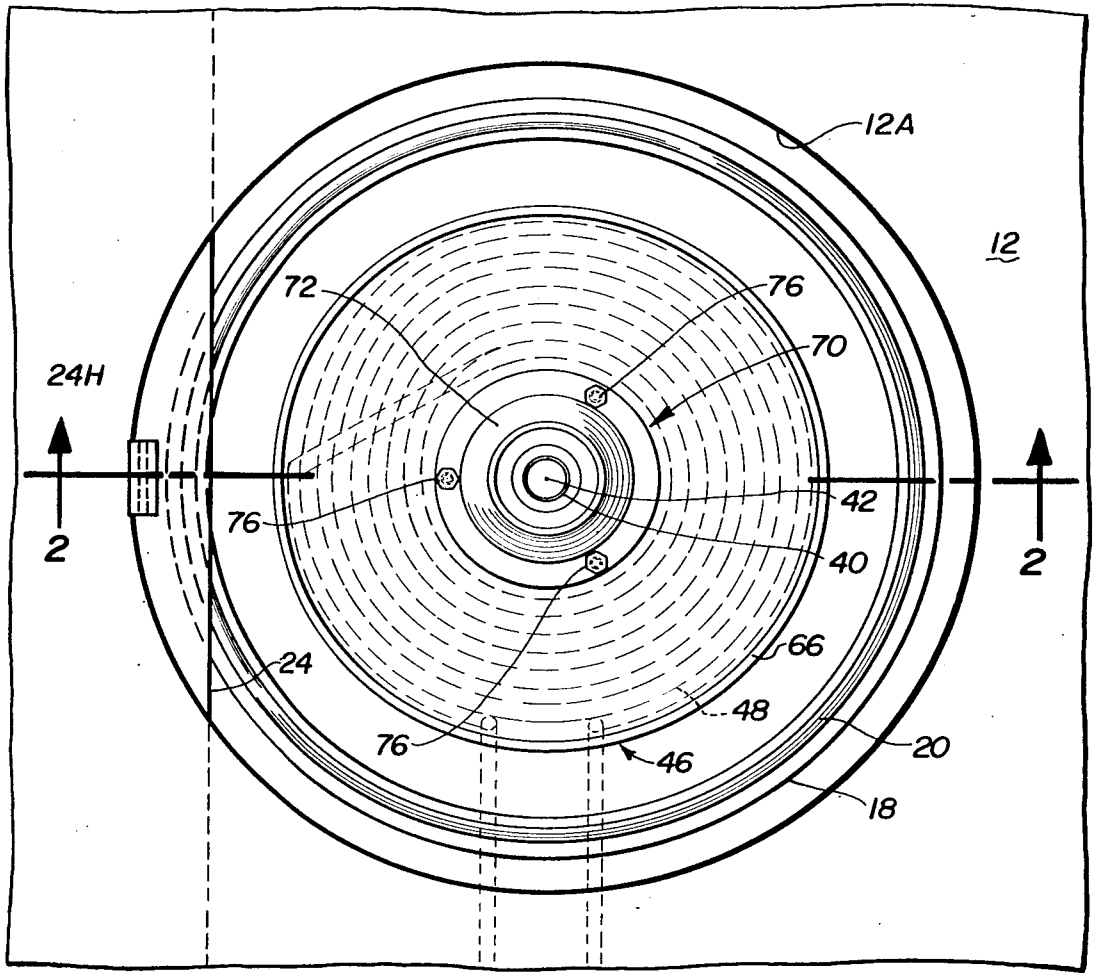
FIG. 1 is a plan view of a centrifuge instrument having a removable bowl in accordance with the present invention.
Figure 2:
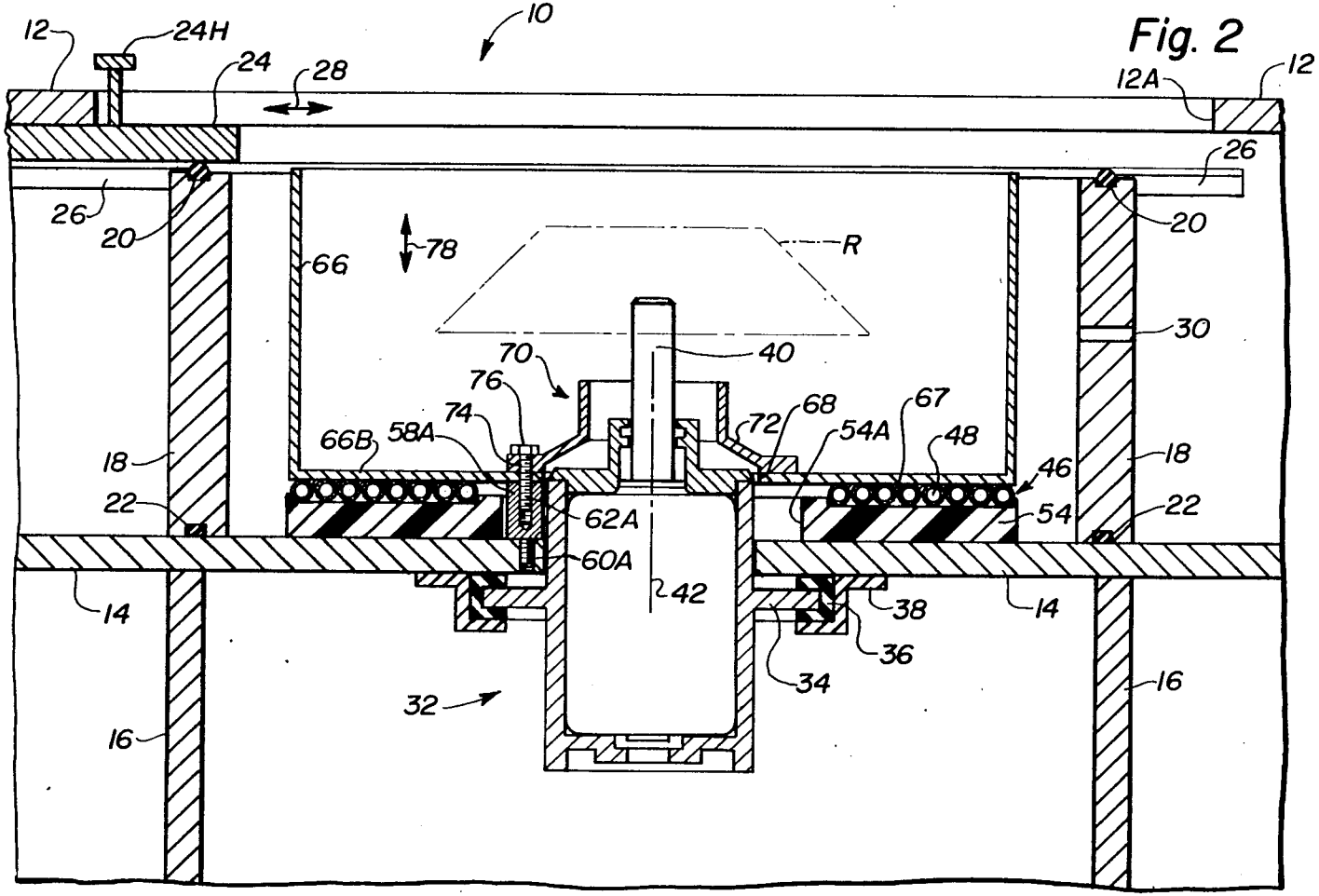
FIG. 2 is a side elevational view entirely in section taken along section lines 2—2 in FIG. 1.

Throughout the following detailed description similar reference numerals refer to similar elements in all figures of the drawings.

With reference to the figures a centrifuge instrument in accordance with the present invention is generally denoted by reference character 10. The centrifuge 10 includes a casing 12 which is provided to totally surround the components of the instrument. A main plate 14 is supported within the casing 12 by means of support legs 16 which space the lower surface of the main plate 14 above the base of the casing 12. For missile containment purposes one or more guard rings 18 are supported by the main plate 14 on the interior of the casing. Only one of the guard rings 18 is shown in the figures for clarity of illustration. The upper and lower surfaces of the guard ring 18 are provided with O-ring seals 20 and 22 respectively. A centrifuge door 24 is slidably disposed on suitable guide tracks 26 for closing the access aperture 12A formed in the casing 12. As may be appreciated by those skilled in the art the door includes a handle 24H by which the door 24 may be slid in opposed rectilinear directions 28 from an open position (shown in the figures) to a closed position in which the door 24 closes the entirety of the aperture 12A. The undersurface of the door 24 forms a sealed relationship with the O-ring 22 whereby the region or chamber 28 confined within the guard ring 18 may be suitably evacuated through an evacuation port 30 connected in a well-known manner to a vacuum pump of any suitable size.

A centrifuge drive 32 is supported on a mounting flange 24 to a shock mount 36 itself supported in a bracket 38 mounted from the underside of the main plate 14. The drive 32 includes an upwardly extending spindle or shaft 40 which is mounted for rotation about an axis of rotation 42. In the preferred case the drive 32 takes the form of a brushless electric motor although any other suitable electric, pneumatic or hydraulic source may be used. The shaft 40 receives a rotor R.

A refrigerant coil assembly 46 in the form of a plurality of turns of tubing 48 is arranged in a substantially planar array in the evacuated chamber 28 defined on the interior of the casing 12. The refrigeration or evaporation coil 48 is suitably connected to a refrigeration system which is conventional for purposes of discussion here. The coil 48 is mounted on a plate 54 formed of a thermal insulating material. The plate 54 is molded or otherwise contoured from a suitable thermal insulating plastic material such as a glass phenolic. The plate 54 has a central opening 54A therein and is mounted to the plate 14 in any convenient manner (e.g., screws) which will maintain the plate with its opening 54 concentric to the axis 42. The coil 48 forms a continuous spiral which surrounds in a generally concentric manner the axis of rotation 42. It should be appreciated that the coil 48 may be positioned in any convenient alternative manner.

Threadedly secured into the main plate 14 is a plurality of mounting pylons 58A, 58B and 58C. The respective pylons 58 include threaded projections 60 by which the pylons 58 may be conveniently mounted to the plate 14. Each pylon 58 carries an internally threaded recess 62.

A centrifuge bowl 66 having a central aperture 68 therein is received within the evacuated chamber 28 and mounted such that the underside of the base portion 66B of the bowl 66 is engaged in thermal contact with the coil 48. To facilitate the thermal contact a suitable thermal conducting material 67 may be provided on the undersurface of the base 66B of the bowl thereby to form a thermal path between the refrigerant coil 48 and the bowl 66. Suitable for use as the thermal conductive material is the mixture of synthetic resin, plasticizer and high thermal conductive fiber such as that sold by Virginia Chemicals, Inc., Dallas, Tex., as "Thermal Mastic." Surrounding the central aperture 68 of the bowl 66 is a collar 70 having a truncated cone-shaped base 72. The base 72 of the collar 70 includes threaded openings 74 which are arranged to coincide with the threaded recesses 66 provided in the pylons 58. An array of mounting bolts 76 are received through the threaded openings 74 in the base 72 of the collar 70 and thereby serve to secure the bowl 66 into the mounting pylons 58.

In accordance with the present invention after removal of the rotor R the bowl 66 may be expeditiously removed from the interior of the vacuum chamber 28 by the straightforward expedient of removing each of the threaded bolts 76 and the mounting collar 70. Thereafter, the bowl 66 may be grasped and removed outwardly of the casing 12 in a direction 78 parallel to the axis of rotation 42. The refrigeration coil 48 remains mounted in the plate 54. In this manner both the beneficial effects of the more efficient liquid refrigeration system may be maintained and utilized to maintain the samples carried in the rotor at a predetermined temperature while at the same time the bowl may be quickly and efficiently removed from the interior of the casing 12 through the aperture 12A therein.

Those skilled in the art having benefit of the present invention as described hereinabove may effect numerous modifications thereto. These modifications are, however, to be construed as lying within the scope of the present invention as defined in the appended claims.

What is claimed is:

1. A centrifuge comprising:

a casing;

a drive member mounted within the casing, the drive member having a shaft mounted for rotational movement about an axis of rotation;

a refrigeration coil formed in a substantially planar array mounted within a casing;

a bowl mounted within the casing in thermal contact with the coil, the bowl being removable from the casing in a direction substantially parallel to the axis of rotation;

a thermally conductive material disposed between the bowl and the refrigeration coil; and a formed plate of thermally insulated material corresponding in shape to the coil for supporting the coil within the casing.

2. A centrifuge comprising:

a casing;

a drive member mounted within the casing, the drive member having a shaft mounted for rotational movement about an axis of rotation;

a refrigeration coil formed in a substantially planar array mounted within a casing;

a bowl mounted within the casing in thermal contact with the coil, the bowl being removable from the casing in a direction substantially parallel to the axis of rotation; and a mounting arrangement for mounting the bowl within the casing, the mounting arrangement comprising an array of mounting pylons secured to the casing and a plurality of mounting members securing the bowl to the pylons.

3. The centrifuge of claim 2 further comprising a thermally conductive material disposed between the bowl and the refrigeration coil.

4. The centrifuge of claim 3 further comprising a formed plate of thermally insulated material corresponding in shape to the coil for supporting the coil within the casing.

5. The centrifuge of claim 2 further comprising a formed plate of thermally insulated material corresponding in shape to the coil for supporting the coil within the casing.

* * * * *